US007488878B2

(12) United States Patent
LaMarra

(10) Patent No.: US 7,488,878 B2
(45) Date of Patent: Feb. 10, 2009

(54) STRING SADDLE FOR A GUITAR

(76) Inventor: Frank LaMarra, 7305 Creekview, West Bloomfield, MI (US) 48322

( * ) Notice: Subject to any disclaimer, the term of this patent is extended or adjusted under 35 U.S.C. 154(b) by 164 days.

(21) Appl. No.: 11/333,734

(22) Filed: Jan. 17, 2006

(65) Prior Publication Data

US 2006/0179999 A1 Aug. 17, 2006

Related U.S. Application Data

(60) Provisional application No. 60/644,128, filed on Jan. 14, 2005.

(51) Int. Cl.
*G10D 3/04* (2006.01)

(52) U.S. Cl. ..... 84/298; 84/299

(58) Field of Classification Search ..... 84/298, 84/299

See application file for complete search history.

(56) References Cited

U.S. PATENT DOCUMENTS 3,237,502 A * 3/1966 Moseley ..... 84/267
3,290,980 A 12/1966 Fender
4,026,181 A * 5/1977 Barcus et al. ..... 84/291
4,031,799 A * 6/1977 Fender ..... 84/307
4,248,126 A * 2/1981 Lieber ..... 84/299
4,491,051 A * 1/1985 Barcus ..... 84/731
4,541,320 A * 9/1985 Sciuto ..... 84/298
4,632,005 A * 12/1986 Steinberger ..... 84/313
4,633,754 A * 1/1987 Chapman ..... 84/314 R
4,681,010 A 7/1987 Wilkinson
4,858,509 A * 8/1989 Marshall ..... 84/646
4,867,031 A * 9/1989 Fender ..... 84/313
5,173,565 A * 12/1992 Gunn ..... 84/298
5,305,675 A * 4/1994 Lasner ..... 84/313
5,542,330 A * 8/1996 Borisoff ..... 84/298
5,750,910 A * 5/1998 LoJacono ..... 84/314 N
5,952,593 A * 9/1999 Wilder ..... 84/314 R
6,040,510 A * 3/2000 Yaun ..... 84/294
6,133,515 A * 10/2000 Hoshino ..... 84/307
6,348,646 B1 * 2/2002 Parker et al. ..... 84/297 R
6,465,722 B2 * 10/2002 Powers ..... 84/298
6,521,819 B1 * 2/2003 Di Iorio ..... 84/298
6,706,957 B1 * 3/2004 Merkel ..... 84/314 N
7,019,202 B1 * 3/2006 Hetzel ..... 84/299
7,154,032 B2 * 12/2006 Burchfield ..... 84/304

(Continued)

OTHER PUBLICATIONS

Warmoth Nuts, www.warmoth.com/guitar/necks/necks.cfg?fuseaction=stringnut, Nut of same material as the frets., viewed Jul. 30, 2007.*

(Continued)

*Primary Examiner*—Walter Benson
*Assistant Examiner*—Robert W Horn
(74) *Attorney, Agent, or Firm*—Harness, Dickey & Pierce, PLC

(57) ABSTRACT

A guitar bridge including a bridge plate attached to a guitar body and a sustain block attached to the bridge plate is provided. The sustain block is positioned within a cavity of the guitar body. The position of the bridge plate may be fixed relative to the guitar body. The sustain block may have a positioning screw for contacting a sidewall of the cavity. A position of the bridge plate and sustain block may be controlled by the positioning screw.

10 Claims, 5 Drawing Sheets

U.S. PATENT DOCUMENTS

| | | | | |
|---|---|---|---|---|
| 7,326,839 | B2 * | 2/2008 | Kinoshita | 84/298 |
| 2002/0088331 | A1 * | 7/2002 | Pecanic | 84/307 |
| 2006/0162528 | A1 * | 7/2006 | Kinoshita | 84/298 |

OTHER PUBLICATIONS

Parker Nitefly Mojo, staninless steel saddles, stainless steel frets, viewed Jul. 30, 2007, www.zzounds.com/items—PRKNFO, launched Jul. 9, 2003. www.parkerguitars.com/code/press/pres_display.asp?pressid=25, viewed Jul. 30, 2007.*

RMC Pickup Co., Pow'r Bass: Polyphonic Bridge Pickup for Wilkinson-style bridges; May 8, 1999 per Internet Archive Wayback Machine.

RMC Pickup Co., Pow'r Bass 'ST': Polyphonic Bridge Pickup for Eelctric Guitar; Aug. 24, 1999 per Internet Archive Wayback Machine.

Fishman Transducers, Inc—Electric Guitar Pickup and Accessories, Feb. 13, 2004 per Internet Archive Wayback Machine.

Fret Not Guitar Repair: Guitar Saddles, Nov. 14, 2002, per Internet Archive Wayback Machine.

Author: Erlewine, D., Title: How to Make Your Electric Guitar Play Great, Library of Congress Control No. 00-136124, ISBN 0-87930-601-7, p. 67.

* cited by examiner

STRING SADDLE FOR A GUITAR

CROSS-REFERENCE TO RELATED APPLICATIONS

This application claims the benefit of U.S. Provisional Application No. 60/644,128, filed on Jan. 14, 2005. The disclosure of the above application is incorporated herein by reference in entirety for any purpose.

FIELD

The present invention relates to a guitar bridge, and more particularly to a fixed guitar bridge with sustain block and fret wire saddles.

BACKGROUND

A guitar's unique tone and playability is the result of many factors, including the type and configuration of the guitar bridge and saddles. For example, Stratocaster style guitars are traditionally equipped with either a tremolo bridge or a fixed-tail bridge. Characteristics of both types of bridges impact the overall tone of the guitar in recognizable ways. In addition, both types of bridges offer unique playability characteristics, related to tuning stability and tremolo functionality.

The fixed-tail guitar bridge typically includes a bridge plate and string saddles. The bridge plate attaches directly to the front of the guitar body such that the bridge plate does not move relative to the guitar body. Guitar strings are installed either through the end of the bridge plate or through the back of the guitar body, via string ferrules. Because of the fixed position of the bridge plate, and the stable attachment of the bridge plate to the guitar body, a guitar equipped with a fixed-tail bridge offers greater tuning stability than a guitar with a pivoting bridge, such as a tremolo bridge. However, the fixed-tail bridge does not utilize a sustain block or springs.

A tremolo bridge for a Stratocaster style guitar typically includes a bridge plate, a sustain block, springs, and a tremolo bar. One end of the bridge plate is beveled to allow the bridge plate to pivot or rock. Bridge mounting screws attach the beveled end of the bridge plate to the front of the guitar body via bridge mounting holes on the beveled end. The bridge mounting screws are configured such that a smooth shank portion of the screw is exposed above the guitar body and below the screw head. When the bridge plate pivots, the bridge mounting holes slide on the smooth shank portions of the bridge mounting screws.

The tremolo bar is received through an aperture in the bridge plate by a sustain block that is attached to the bridge plate and positioned in a cavity within the guitar body. The bridge plate is asymmetrically designed, with a greater portion of the bridge plate on the side of the tremolo bar to allow for the aperture through which the tremolo attaches to the sustain block.

Guitar strings on a guitar with a tremolo bridge are installed through the sustain block and bridge plate. The guitar strings are fed through string saddles attached to the guitar bridge. Traditionally, the strings are fed through grooves or channels in the string saddles. At the other end of the guitar, the guitar strings are fed through a nut and string trees and attached to tuning keys on the head stock. The portion of the guitar string between the string saddles and the nut vibrates when plucked or strummed producing the guitar's sound. When the guitar player frets a note, the vibrating portion of the string between the fret and the string saddle produces the sound. The material and shape of the string saddles, nut, and frets each affect the tone of the guitar in recognizable ways.

Springs attached to the sustain block impart a biasing force on the sustain block, and bridge plate, returning the bridge plate to a flat position relative to the guitar body when the tremolo bar is not being operated. When the tremolo bar is operated, the sustain block and bridge plate pivot and the pitch of the note being played is lowered. The tremolo bar may be operated by successive pushing and releasing to achieve a vibrato effect.

While the sustain block and springs are integral to the operation of the tremolo bar, each contributes in a recognizable way to the overall tone of the guitar even when the tremolo bar is not operated. For example, the sustain block increases the resonance of a note being played, while the springs increase the reverberation of the note. Thus, the tone enhancing effects of the sustain block and tension springs are desirable characteristics of the tremolo bridge aside from the tremolo bar functionality.

Further, the pivoting aspect of the bridge plate is often an undesirable characteristic of the tremolo bridge. Guitars with a tremolo bridge are more difficult to keep in tune than guitars equipped with a fixed-tail bridge. Guitars with a tremolo bridge must be retuned frequently during a performance. In addition, depending on the musical setting, the vibrato effect accomplished by the tremolo bar may not be musically appropriate.

For these reasons, the tremolo bar is often removed completely from the tremolo bridge. Removal of the tremolo bar, however, leaves the aperture on the bridge plate exposed, which may be aesthetically displeasing. Removal of the bar leaves the asymmetrical bridge plate exposed as well, which may also be aesthetically displeasing.

In addition to removing the tremolo bar, the sustain block is often "blocked" by a wood block, wedge, or shim within the sustain block cavity. Blocking the sustain block prevents the rocking action of the tremolo bridge. (Eric Clapton is said to have blocked the sustain block of the tremolo bridge on his Stratocaster.) The bridge plate remains attached to the face of the guitar by the bridge plate mounting screws on the beveled edge which are configured to allow for pivoting of the bridge plate. These pivoting features are undesirable, and unnecessary, when the sustain block has been blocked to prevent pivoting of the bridge plate.

Thus, an aesthetically desirable bridge with the tuning stability of a fixed-tail bridge and the tone enhanced characteristics of a tremolo bridge is needed.

SUMMARY

Accordingly, a guitar bridge with a bridge plate attached to a guitar body, and a sustain block attached to the bridge plate and positioned within a cavity of the guitar body is provided.

In one feature, a position of the bridge plate is fixed relative to the guitar body.

In another feature, the sustain block has positioning screws for contacting sidewalls of the cavity of the guitar body. The position of the bridge plate and the sustain block is controlled by the positioning screws.

Additionally, a string saddle for a guitar is provided. The string saddle includes a saddle body with a fret wire receiving channel.

Further areas of applicability of the present invention will become apparent from the detailed description provided hereinafter. It should be understood that the detailed description and specific examples, while indicating the preferred embodiment of the invention, are intended for purposes of illustration only and are not intended to limit the scope of the invention.

BRIEF DESCRIPTION OF THE DRAWINGS

The present teachings will become more fully understood from the detailed description and the accompanying drawings, wherein.

DETAILED DESCRIPTION

The following description is merely exemplary in nature and is in no way intended to limit the invention, its application, or uses.

Referring to FIGS. 1-6 a guitar bridge 10 is shown. The guitar bridge 10 includes a bridge plate 12, and a sustain block 14.

Figure 2:
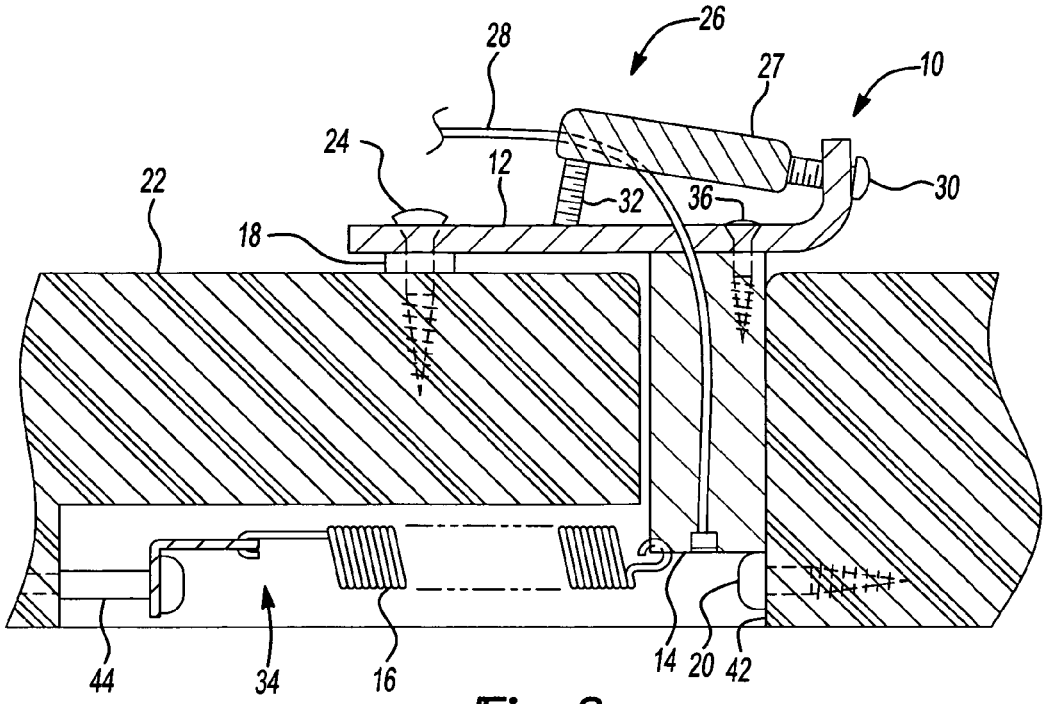
FIG. 2 is a cross-sectional view of a guitar bridge, with springs, positioned offset from a guitar body.
Figure 3:
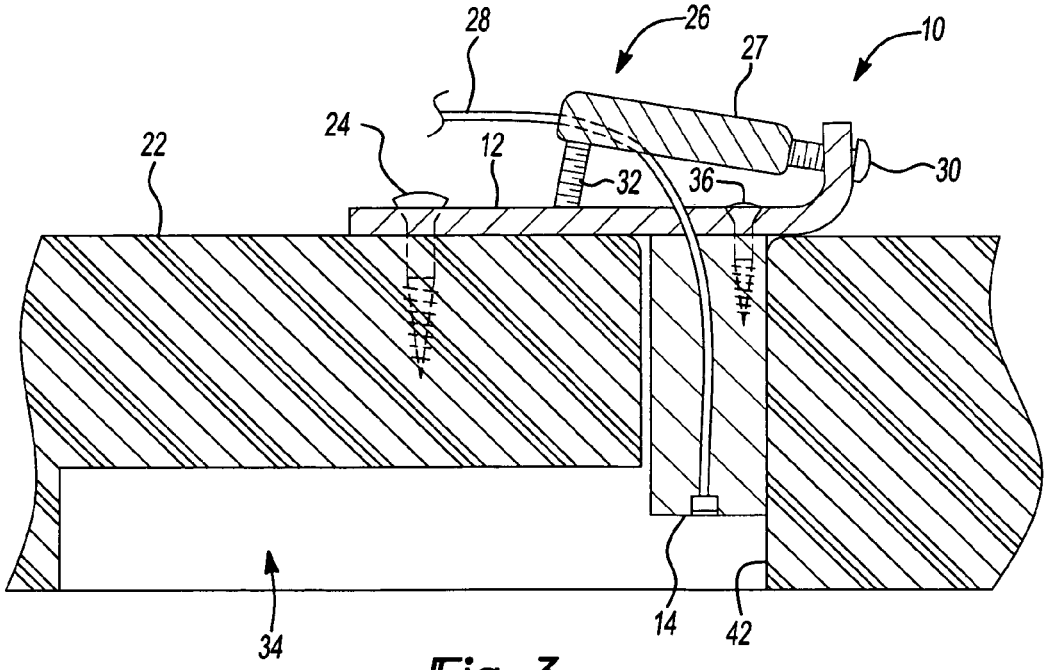
FIG. 3 is a cross-sectional view of a guitar bridge, without springs, positioned flush against a guitar body.

Referring now to FIGS. 2 and 3, the bridge plate 12 is attached to the front of a guitar body 22 with at least one plate-to-body mounting screw 24. Two plate-to-body mounting screws 24 may secure the bridge plate 12 to the front of the guitar body 22. Additional plate-to-body mounting screws 24 may be used. For example, four plate-to-body mounting screws 24 may be used with one plate-to-body mounting screw at each corner of the bridge plate 12. The position of the bridge plate 12 is fixed relative to the guitar body 22. At least one string saddle 26 with a saddle body 27 is positioned on the bridge plate 12, and includes a slot or channel for receiving a guitar string 28. The string saddle 26 is attached to the bridge plate 12 with a string saddle mounting screw 30. The angle of the string saddle 26 relative to the bridge plate 12 is adjusted via string saddle adjusting screws 32. In a six string guitar embodiment, such as a Stratocaster style guitar, six string saddles 26 are positioned on the bridge plate 12. It is understood that any suitable string saddle 26 may be installed on the bridge plate 12.

A sustain block 14 is positioned beneath the bridge plate 12 within a cavity 34 of the guitar body 22. The sustain block 14 is attached to the bridge plate 12 via at least one plate-to-block mounting screw 36 such that the top of the sustain block 14 is flush against the underside of the bridge plate 12. In this way, a stable coupling exists between the bridge plate 12 and sustain block 14. Three plate-to-block mounting screws 36 may be used to secure the bridge plate 12 to the sustain block 14. Guitar strings 28 are installed through string apertures in the sustain block 14 and the bridge plate 12. The guitar strings 28 are received by the string saddles 26. The ends of the guitar strings 28 are terminated with a string terminator, such as a ball, a bullet, a ring, or other suitable means for terminating the guitar string such that it may be pulled taut against the sustain block 14. The string apertures include a recessed portion to allow the string terminator to be positioned within the sustain block 14 such that no portion of the terminator extends beyond the end of the sustain block 14. In an alternate embodiment, the string apertures may not include the recessed portion.

In this way, a bridge plate 12 is stably attached to the guitar body 22 in a fixed position. The bridge plate 12 is configured with a sustain block 14 that is stably attached to the bridge plate 12. The bridge 10 provides the tuning stability typically associated with a fixed-tail bridge as well as the tone enhancing characteristics typically associated with a sustain block 14 of a tremolo bridge. Because a tremolo bar is not included, the bridge plate 12 may be symmetrically designed. Further, the sustain block 14 need not be "blocked" in order to prevent pivoting of the sustain block 14.

Figure 1:
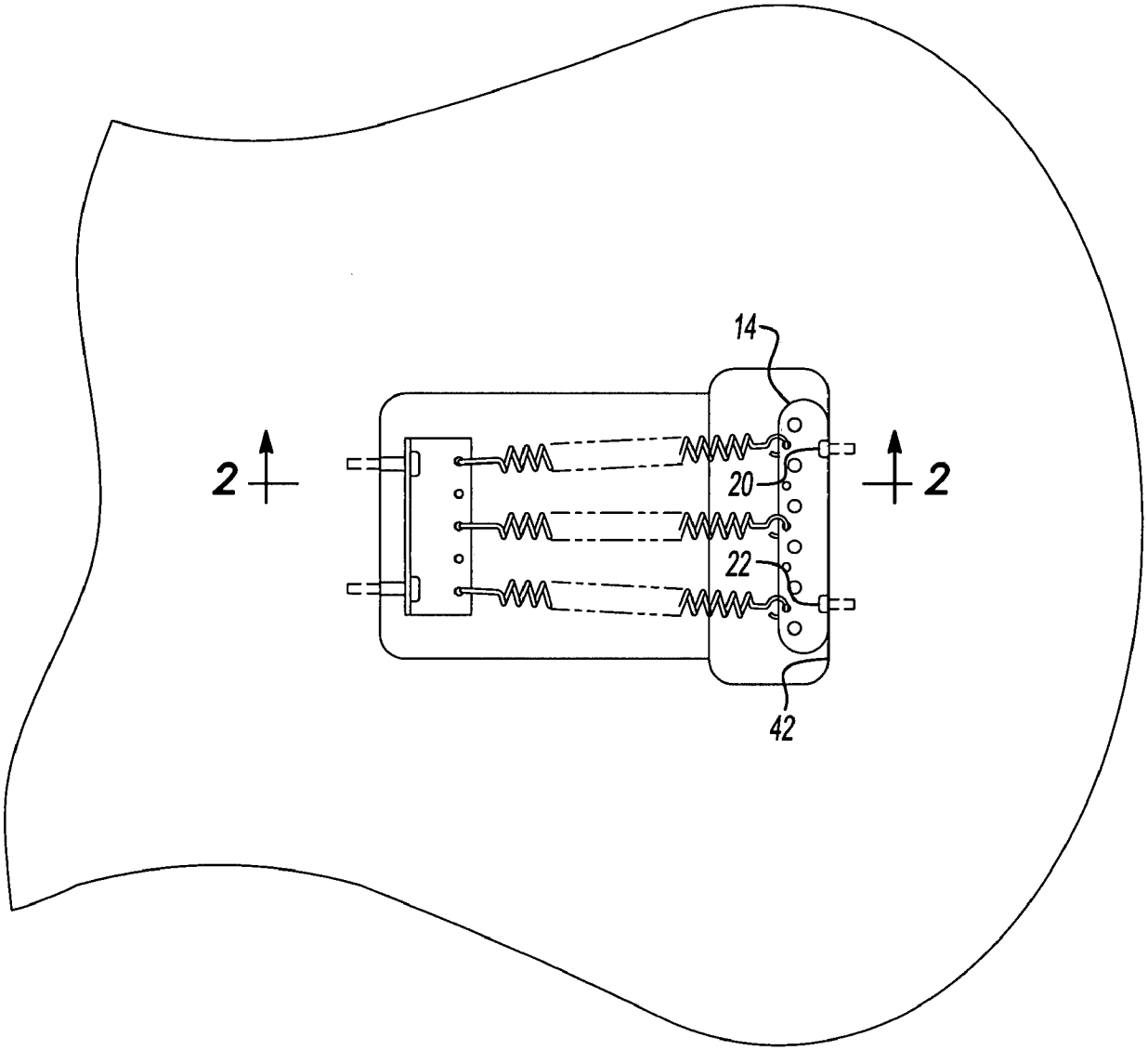
FIG. 1 is a perspective view of a sustain block and tremolo springs.

Because the bridge plate 12 does not pivot, springs 16 are not required for the bridge 10 to function. However, at least one spring 16 may be installed nonetheless to increase the reverberation. For example, three springs 16 may be installed. Springs 16 are attached to the sustain block 14 and to a spring mounting bracket 44 within the cavity 34. In FIGS. 1 and 2, the guitar bridge 10 is illustrated with springs 16 installed. In FIG. 3, the guitar bridge 10 is illustrated without springs 16 installed. The springs 16 are removable and may be easily reinstalled to suit changing tone preferences. Additionally, the number and size of the springs 16 may be varied to suit changing tone preferences as well.

The sustain block 14 is wide enough to receive all of the strings 28 of the guitar. A traditional Stratocaster style guitar utilizes six strings 28. However, guitars with more or with less strings 28 are not uncommon. In addition, a traditional bass guitar utilizes four strings 28. In an alternate embodiment, the guitar bridge 10 may be adapted to accommodate guitars, or bass guitars, with any number of strings 28.

Because the sustain block 14 does not receive a tremolo bar, the sustain block 14 need not be as wide as the sustain block 14 utilized by a tremolo bridge. However, the size, including the height, width, and thickness, of the sustain block 14 may vary the tone of the guitar. Resonance increases as the mass of the sustain block 14 increases. Sustain blocks 14 of varying size and mass could be alternately installed on a guitar to suit changing tone preferences.

In FIG. 1, the sustain block 14 is positioned within the cavity such that the sustain block 14 is flush against a sidewall 42 of the cavity 34. The sustain block 14, however, need not be flush against the sidewall 42 of the cavity 34 to function properly. Thus, the guitar bridge 10 is compatible with any suitable guitar body cavity 34 large enough to receive the sustain block 14.

The position of the bridge plate 12 relative to the guitar body 22 affects the overall guitar tone. The bridge plate 12 may be offset from the guitar body 22 or flush against the guitar body 22. In FIG. 2, the bridge plate 12 is offset from the guitar body 22. Offset washers 18 are installed between the bridge plate 12 and the guitar body 22 such that the plate-to-body mounting screws 24 are received by the offset washers 18. The amount of bridge position offset may be adjusted by varying the thickness of the offset washers 18. A guitar with a bridge 10 that is offset relative to the guitar body 22 will have a unique tone that may be preferable to other guitars with other bridge configurations. A bridge plate 12 that is offset from the guitar body 22 may produce a tone similar to that produced by a tremolo bridge with a pivoting beveled end bridge plate than a bridge plate attached flush with the guitar body. In addition, the offset position of the bridge plate 12 may be preferable to those who desire to distinguish the tone of their Stratocaster style guitar from the tone of a Telecaster style guitar. Telecaster style guitars are traditionally equipped with a fixed bridge plate 12 that is attached flush against the guitar body 22.

In FIG. 3, the bridge plate 12 is attached flush against the guitar body 22 without an offset. A guitar with a bridge 10 that is flush against the guitar body 22 will also have a unique tone that may be preferable to other guitars with other bridge configurations. For example, some may desire to make the tone of their Stratocaster style guitar sound more like a traditional Telecaster style guitar by attaching the bridge plate 12 flush against the guitar body 22.

Referring now to FIGS. 1 and 2, securing screws 20 are attached to the sidewall 42 of the cavity 34, further securing the position of the sustain block 14 within the cavity 34. Because the sustain block 14 is attached flush against the bridge plate 12, securing screws 20 are not essential for the bridge 10 to function. However, the securing screws 20 provide additional position stability for the sustain block 14, and also provide a coupling between the sustain block 14 and the guitar body 22 which affects the overall guitar tone in a unique way. The securing screws 20 may not be included. In FIG. 3, the guitar bridge 10 is illustrated without securing screws 20.

In FIG. 2, in an embodiment with a bridge plate 12 that is offset from the guitar body 22, and that utilizes springs 16, the securing screws 20 may secure the sustain block 14 in the desired position. As described above, the bridge 10 may be configured with a number of springs 16, of varying size. The tension of the springs 16 may pull on the sustain block 14 and bridge plate 12, pulling the bridge plate 12 towards the guitar body 22. In such a configuration, securing screws 20 may be used to stabilize the position of the sustain block 14. In this way, additional springs 16 may be added without affecting the position of the sustain block 14 and bridge plate 12.

Figure 5:
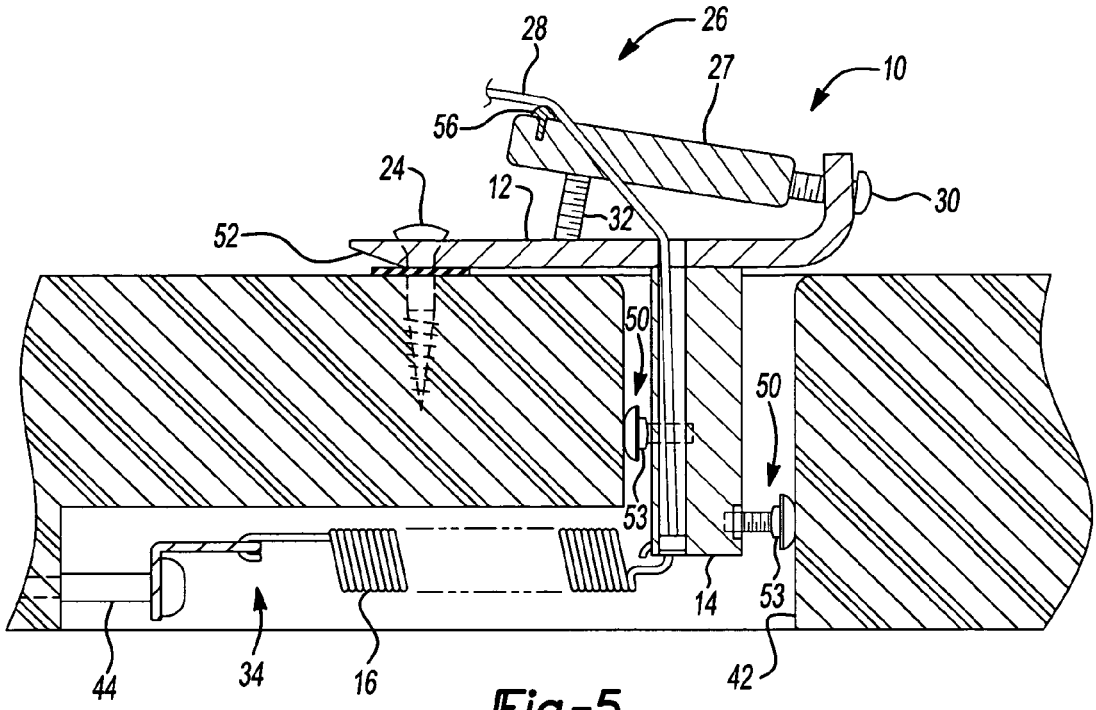
FIG. 5 is a cross-sectional view of a guitar bridge with positioning screws and with springs.
Figure 6:
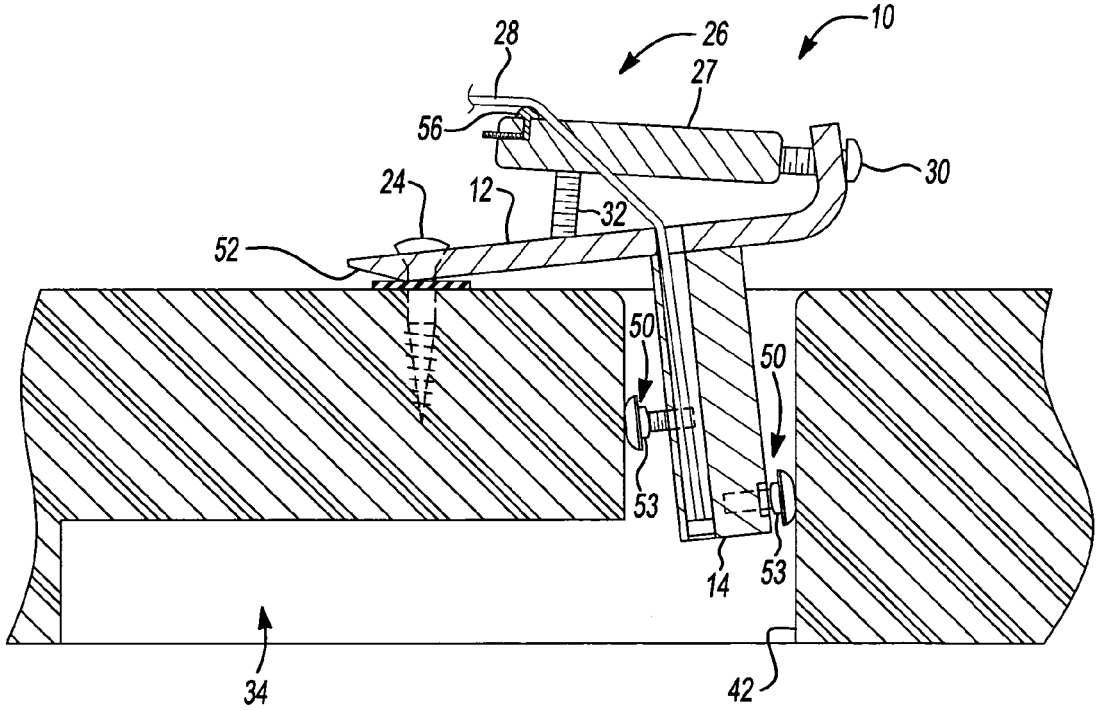
FIG. 6 is a cross-sectional view of a guitar bridge with positioning screws and without springs.

Referring now to FIGS. 5 and 6, a guitar bridge 10 is shown with positioning screws 50 attached to the sustain block 14. The positioning screws 50 are attached to opposite sides of the sustain block 14. The heads of the positioning screws 50 contact the sidewalls 42 of the cavity 34. The bridge plate 12 includes a beveled edge 52. The position of the sustain block 14 within the cavity and the angle of the bridge plate 12 with the guitar body is fixed by the positioning screws 50. For example, in FIG. 5, the positioning screws are adjusted such that the bridge plate 12 is parallel with the guitar body 22 and the sustain block 14 is parallel with the sidewalls 42 of the cavity 34. In FIG. 6, the positioning screws 50 are adjusted such that the bridge plate 12 is angled away from the guitar body 22. By adjusting the positioning screws 50, both the position of the sustain block 14 within the cavity 34 and the angle of the bridge plate 12 with the guitar body 22 are controlled. The position of the sustain block 14 within the cavity 34 and the angle of the bridge plate 12 with the guitar body may be adjusted to suit the preferences of the guitar player. The sustain block 14 may be configured with springs, as shown in FIG. 5, or without springs, as shown in FIG. 6.

Two positioning screws 50, one on each side of the sustain block, are shown in FIGS. 5 and 6. However, one positioning screw 50 may be used. For example, to position the bridge plate 12 flat against the guitar body 22, one positioning screw 50 on the side of the sustain block 14 opposite the beveled endedge 52 of the bridge plate 12 may be used. Further, more than two positioning screws 50 may be used for additional coupling between the sustain block 14 and the guitar body 22.

The sustain block 14 includes bores for receiving the positioning screws 50. The head of the positioning screws 50 may include an adjustment portion 53, such as a hex nut portion, beneath the screw head to allow for wrench adjustments of the positioning screws 50. The bores may include counter-sinks for receiving the adjustment portion 53 of the positioning screw 50. In this way, the head of the positioning screw 50 may be flush against the sustain block 14 when the positioning screw 50 is screwed all the way in to the sustain block 14.

Figure 7A:
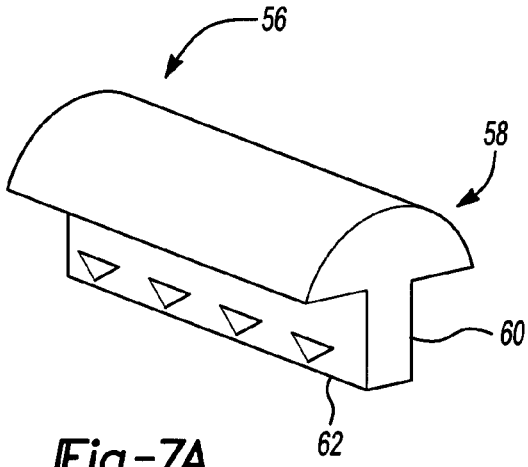
FIG. 7A is a fret wire.
Figure 7B:
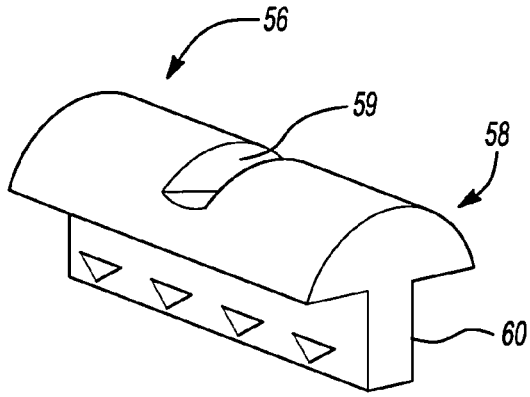
FIG. 7B is a fret wire with a groove for receiving a guitar string.

In FIGS. 5 and 6 the string saddles 26 are configured with fret wire 56. As shown in FIGS. 7A and 7B, the fret wire 56 includes a crown 58 and a tang 60. The sidewalls of the tang include barbs 62. The crown 58 may include a groove 59 for receiving a guitar string 28, as shown in FIG. 7B. The crown 58 may not include a groove, as shown in FIG. 7A.

Referring again to FIGS. 5 and 6, the fret wire 56 is positioned within a fret wire receiving channel in the saddle body 27. The barbs 62 engage the sidewalls of the fret wire receiving channel to secure the tang 60, and consequently the fret wire 56. Additionally, a set screw 64 may be used to further secure the fret wire 56. The set screw 64 is received by a bore in the end of the saddle body 27 opposite the string saddle mounting screw 30. The set screw 64 engages the tang to secure the fret wire 56 in the fret wire receiving channel in the saddle body 27.

The guitar string 28 is strung through the sustain block 14, through the bridge plate 12, through the string saddle 26, and over the fret wire 56. In this way the guitar string 28 leaves the string saddle 26 over the fret wire 56 which provides a pronounced terminating point for the vibrating section of the guitar string 28. In the traditional string saddle 26 the guitar string 28 leaves the string saddle 26 through a channel in the string saddle 26. The channel however does not provide a pronounced terminating point for the vibrating section of the guitar string 28. In FIGS. 5 and 6, the fret wire 56 in the string saddle 26 bends the guitar string 28 as it exits the string saddle 26 at a definite angle. In the traditional string saddle 26, the guitar string 28 is not bent at a definite angle as it exits the string saddle 26.

Figure 4:
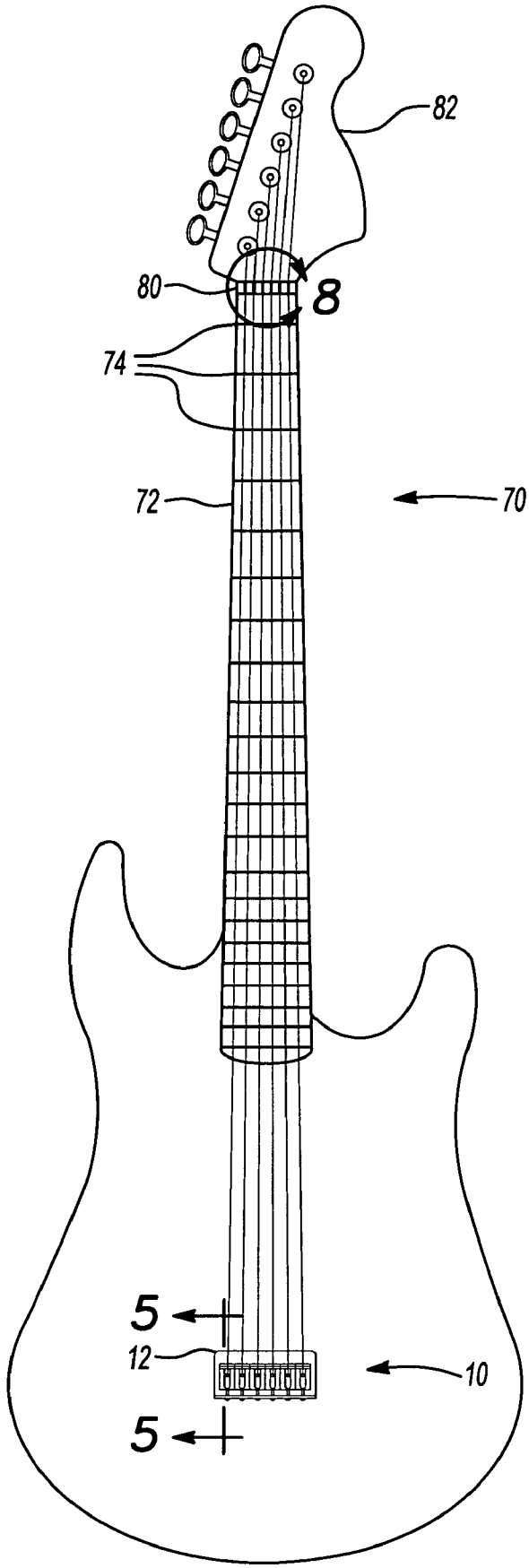
FIG. 4 is a view of a guitar with a guitar bridge, a fret board, and a nut.

With additional reference to FIG. 4, the neck 70 of the guitar includes a fret board 72. The frets 74 on the fret board 72 are constructed by placing fret wire 56 in fret wire receiving channels on the fret board 72 that are perpendicular to the guitar strings 28. The fret wire 56 is placed in the fret wire receiving channel such that the underside of the crown 58 is flush with the fret board 72. The barbs 62 of the fret wire 56 engage the sidewalls of the fret wire receiving channels in the fret board 72.

The fret wire 56 in the string saddles 26 may be the same material as the fret wire 56 in the fret board 70 of the guitar. In constructing a guitar, stock fret wire 56 is cut to the desired lengths and installed on the fret board 72. The same stock fret wire 56 used in the fret board 72 can also be cut to match the width of the saddle body 27 and installed on each string saddle 26.

Figure 8:
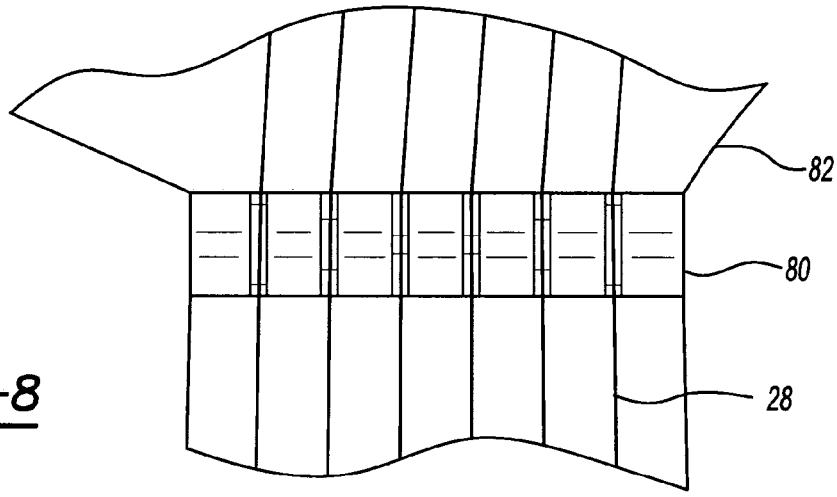
FIG. 8 is a nut and headstock.
Figure 9:
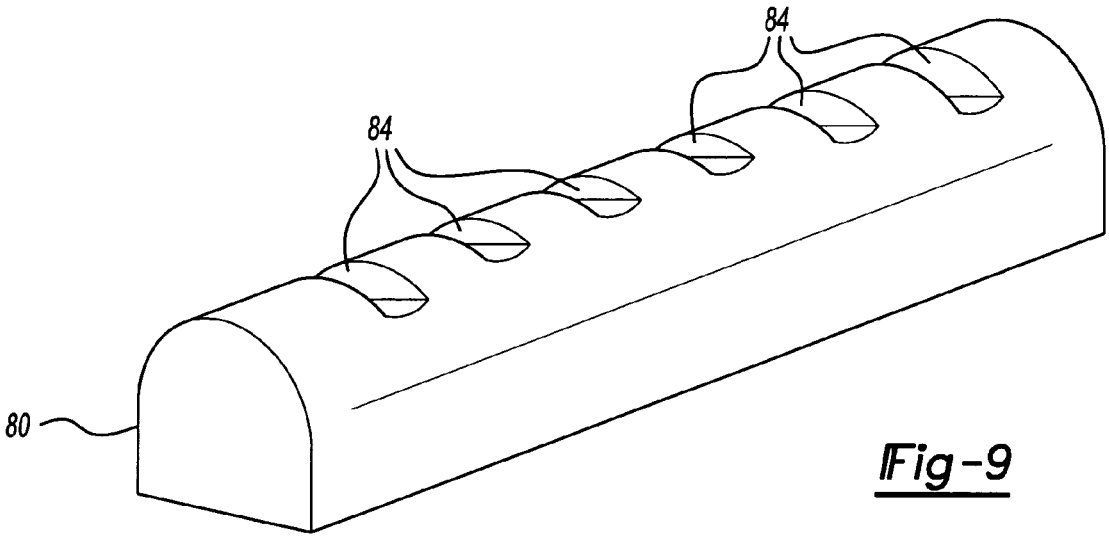
FIG. 9 is a nut.

Referring now to FIGS. 4, 8, and 9, a nut 80 is installed on the headstock 82 of the guitar. The guitar strings 28 are received by channels 84 in the nut. The nut 80 terminates the vibrating portion of the guitar string 28. Thus, while the ends of the guitar string 28 are located at the sustain block 14 and the tuning keys 86, the vibrating portion of the guitar string 28 is located between the nut 80 and the string saddle 26. The guitar player may press the guitar string 28 behind one of the frets 74 in the fret board 72 to play a desired note. In such case, the vibrating portion of the guitar string 28 is between the string saddle 26 and the chosen fret 74 in the fret board 72.

The material of the nut may be chosen to match the material of the fret wire 56 used in both the fret board 72 and the string saddles 26. In this way, the vibrating portion of the guitar string will contact the same type of material at the nut, at the frets 74 in the fret board 72 and at the fret wire 56 in the string saddles 26. This uniformity of material produces a distinct and desirable tone. The guitar produces crisp and sharp notes regardless of whether the guitar strings are fretted or played open.

Because tone preference is a subjective matter, certain configurations of the present invention may be preferable depending on the musical setting and desired target tone.

Further, the description of the invention is merely exemplary in nature and, thus, variations that do not depart from the gist of the invention are intended to be within the scope of the invention. Such variations are not to be regarded as a departure from the spirit and scope of the invention.

What is claimed is:

1. A guitar bridge comprising:

a bridge plate for mounting to a guitar body;

a plurality of string saddles attached to said bridge plate, each string saddle having a saddle body and an adjusting screw for adjusting an angle of said saddle body relative to said bridge plate, each said saddle body having a fret wire receiving channel;

a plurality of fret wires, each fret wire being mounted on a corresponding string saddle of said plurality of string saddles such that a tang of said fret wire is secured within said fret wire receiving channel of said saddle body and a crown of said fret wire is positioned above said saddle body;

wherein each string saddle of said plurality of string saddles is configured to receive a corresponding guitar string when said bridge plate is mounted to said guitar body such that said crown of said fret wire provides a terminating point for a vibrating section of said corresponding guitar string.

2. The guitar bridge of claim 1 wherein said tang includes at least one barb that engages a sidewall of said fret wire receiving channel.

3. The guitar bridge of claim 1 wherein each said saddle body includes a bore for receiving a set screw oriented to secure each said fret wire secured within said fret wire receiving channel.

4. The guitar bridge of claim 1 wherein said crown of each said fret wire has a string receiving groove.

5. The guitar bridge of claim 1 wherein each said string saddle is attached to said bridge plate with a string saddle mounting screw.

6. A guitar comprising:

a guitar body;

a bridge having a bridge plate mounted to said guitar body, a plurality of string saddles attached to said bridge plate, each string saddle having a saddle body and an adjusting screw for adjusting an angle of said saddle body relative to said bridge plate, each said saddle body having a fret wire receiving channel, and a first plurality of fret wires, each fret wire being mounted on a corresponding string saddle body such that a tang of each said fret wire is secured within said fret wire receiving channel of said corresponding string saddle body and a crown of said fret wire is positioned above said corresponding saddle body;

a plurality of guitar strings, each guitar string being received by a corresponding string saddle of said plurality of string saddles such that said crown of said fret wire of said corresponding string saddle provides a terminating point for a vibrating section of a corresponding guitar string.

7. The guitar of claim 6 further comprising:

a neck board attached to said guitar body and including a second plurality of fret wires mounted on said neck board such that said vibrating section is terminated by a crown of a fret wire of said second plurality of fret wires when said corresponding guitar string is depressed against said fret board;

wherein said first plurality of fret wires and said second plurality of fret wires are composed of the same fret wire material.

8. The guitar of claim 6 further comprising a nut positioned on a headstock of said guitar such that said vibrating section is terminated by said nut when said corresponding guitar string is not depressed against said fret board, wherein said nut and said first plurality of fret wires are composed of the same type of material.

9. The guitar of claim 7 further comprising a nut positioned on a headstock attached to said neck board of said guitar such that said vibrating section is terminated by said nut when said corresponding guitar string is not depressed against said fret board, wherein said nut, said first plurality of fret wires, and said second plurality of fret wires are composed of the same type of material.

10. The guitar of claim 6 wherein each said string saddle is attached to said bridge plate with a string saddle mounting screw.

* * * * *